US011103924B2

(12) United States Patent
Schmitt et al.

(10) Patent No.: US 11,103,924 B2
(45) Date of Patent: Aug. 31, 2021

(54) POWDER PRESS HAVING A CONE-SHAPED SUBSTRUCTURE

(71) Applicant: GKN Sinter Metals Engineering GmbH, Radevormwald (DE)

(72) Inventors: Rainer Schmitt, Wachtberg (DE); Eberhard Ernst, Eichenzell (DE)

(73) Assignee: GKN Sinter Metals Engineering GmbH, Radevormwald (DE)

( * ) Notice: Subject to any disclaimer, the term of this patent is extended or adjusted under 35 U.S.C. 154(b) by 824 days.

(21) Appl. No.: 15/548,501

(22) PCT Filed: Feb. 1, 2016

(86) PCT No.: PCT/EP2016/052013
§ 371 (c)(1),
(2) Date: Aug. 3, 2017

(87) PCT Pub. No.: WO2016/124511
PCT Pub. Date: Aug. 11, 2016

(65) Prior Publication Data

US 2018/0236547 A1 Aug. 23, 2018

(30) Foreign Application Priority Data

Feb. 4, 2015 (DE) ..... 10 2015 201 966.7

(51) Int. Cl.
*B29C 43/32* (2006.01)
*B22F 3/03* (2006.01)
(Continued)

(52) U.S. Cl.
CPC ..... *B22F 3/03* (2013.01); *B22F 3/003* (2013.01); *B30B 11/02* (2013.01); *B30B 15/026* (2013.01);
(Continued)

(58) Field of Classification Search
CPC ..... B30B 1/18; B30B 11/02; B30B 11/08; B29C 43/32
See application file for complete search history.

(56) References Cited

U.S. PATENT DOCUMENTS 6,440,357 B1 8/2002 Hinzmann
8,657,594 B2 * 2/2014 Atagi ..... B30B 11/08 425/78
(Continued)

FOREIGN PATENT DOCUMENTS

DE 3241383 A1 5/1984
DE 102010051513 A1 5/2012
(Continued)

OTHER PUBLICATIONS

PCT International Search Report and Written Opinion, PCT/EP2016/052013, dated May 10, 2016, 18 pages.

*Primary Examiner* — Joseph S Del Sole
*Assistant Examiner* — Thu T Nguyen
(74) *Attorney, Agent, or Firm* — Quarles & Brady LLP

(57) ABSTRACT

The invention relates to a powder press, comprising a tool structure, which has a conical substructure having lower rams nested in each other, wherein each lower ram has a longitudinal extent, in particular a cylindrical longitudinal extent, which is guided in a die, wherein, in the case of at least two longitudinal extents of the lower rams, each longitudinal extent is adjoined by a conical enlargement, wherein the conical enlargements can be guided in each other, wherein the region of the conical enlargement has an inner wall and an outer wall, which expand conically and which are preferably longer than the longitudinal extent. The invention further relates to a method for operating a powder press and to a computer program product having computer
(Continued)

Figure 1:
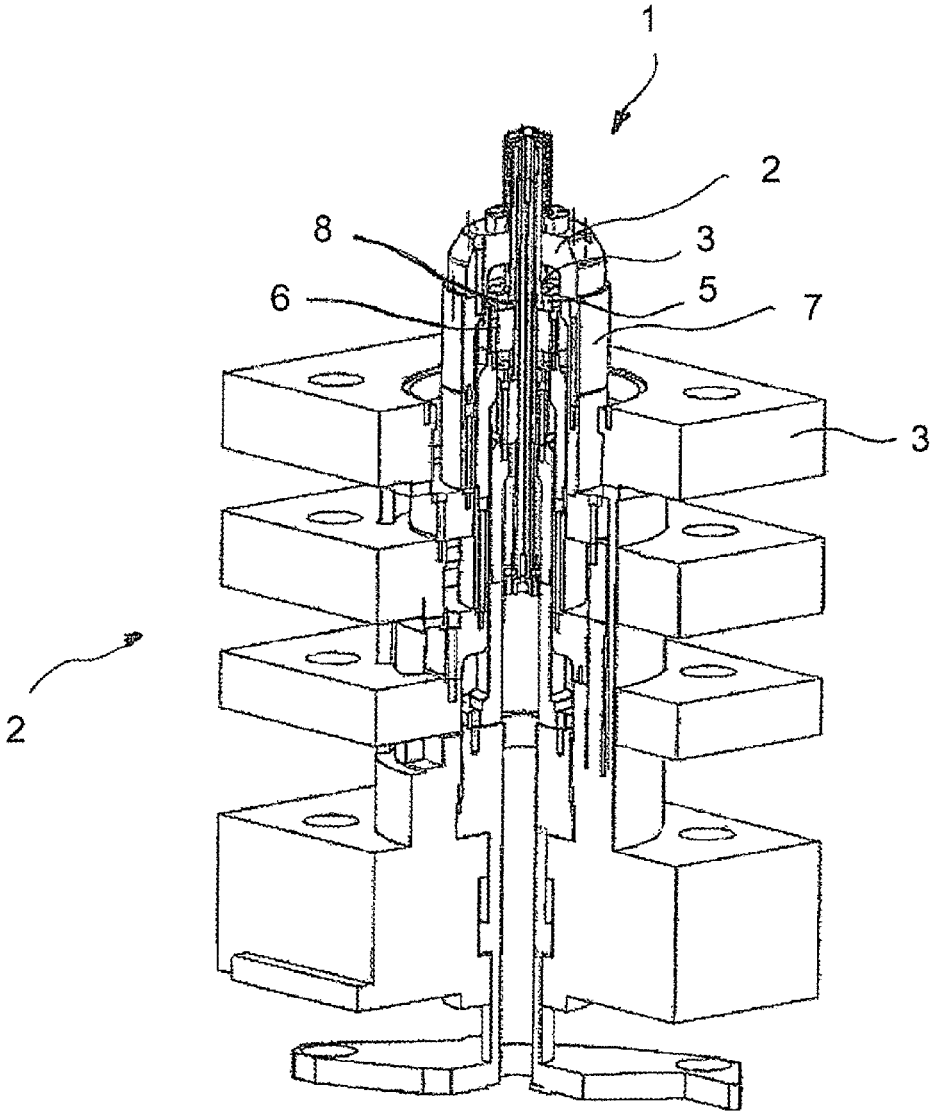
Fig. 1 Prior art

program code means that can be executed on a computer system in order to perform the method.

23 Claims, 7 Drawing Sheets

(51) Int. Cl.

| | |
|---|---|
| ***B30B 11/02*** | (2006.01) |
| ***B30B 15/06*** | (2006.01) |
| ***B30B 15/26*** | (2006.01) |
| ***B22F 3/00*** | (2021.01) |
| ***B30B 15/02*** | (2006.01) |

(52) U.S. Cl.
CPC ..... *B30B 15/065* (2013.01); *B30B 15/26* (2013.01); *B22F 2003/033* (2013.01)

(56) References Cited

U.S. PATENT DOCUMENTS

| | | | | |
|---|---|---|---|---|
| 2007/0062248 | A1 | 3/2007 | Solty et al. | |
| 2007/0087073 | A1* | 4/2007 | Chowdhury ..... | B30B 11/08 425/408 |
| 2013/0313741 | A1 | 11/2013 | Menzel et al. | |

FOREIGN PATENT DOCUMENTS

| | | | |
|---|---|---|---|
| EP | 1764173 | A2 | 3/2007 |
| JP | 2004291046 | A | 10/2004 |
| WO | 0112367 | A2 | 2/2001 |
| WO | 2015140228 | A1 | 9/2015 |

* cited by examiner

POWDER PRESS HAVING A CONE-SHAPED SUBSTRUCTURE

This application represents the U.S. national stage entry of International Application No. PCT/EP2016/052013 filed Feb. 1, 2016, which claims priority to German Patent Application No. 10 2015 201 966.7 filed Feb. 4, 2015, the disclosure of which is incorporated herein by reference in its entirety and for all purposes.

The present invention relates to a powder press having a conical lower punch, in particular substructure, and to a production method and a compact produced with the proposed powder press. The powder press is used to produce in particular bodies that are subsequently to be sintered. In particular, it is possible for metal powders but also ceramic powders to be processed. The compact is preferably a green compact which is subsequently sintered.

A press structure is a decisive factor for determining what kinds of parts can be pressed for how long in what way. The applicant's DE 10 2014 003 726 discloses a press for producing dimensionally accurate green compacts, in which the tool structures used are optimally designed for equalizing elasticity between individual tool levels. To this end, a certain amount of technical effort is required in designing and also producing the tools.

The object of the present invention is to create a simplified press structure which can be produced by conventional methods and shortens the time required for a tool change in addition to time for setup.

The wording of the independent claims should be understood as being a first attempt to reproduce the subject matter of the invention. Therefore, one or more features of the independent claims can be supplemented by one or more features from the disclosure, exchanged therefor or even deleted in order to comprehend the subject matter of the invention better.

A powder press having a tool structure is proposed, wherein the tool structure has a conical substructure with lower punches nested in one another, wherein each lower punch has a longitudinal extent, in particular a cylindrical longitudinal extent, which is guided in a die, wherein at least two longitudinal extents of the lower punches are adjoined in each case by a region with a conical enlargement, wherein the conical enlargements are able to be guided one in another, wherein the region of the conical enlargement has a conically expanding inner and outer wall, which are preferably longer than the longitudinal extent. Preferably, the lower punch forms a length here which is otherwise allowed only with an attached structure. Preferably, the lower punch has at its end an expansion of such a size that, for example, a punch holder is able to be connected directly to this end of the lower punch.

The longitudinal extent extends parallel to an axis of movement of the powder press. Preferably, the longitudinal extent is arranged concentrically about the axis of movement of the powder press. The longitudinal extent is realized, for example, by a head piece in a punch.

The lower punch preferably forms the substructure. This means that the lower punch extends axially and radially in a cone-shaped manner as a hollow cone such that a foot of the lower punch rests for example directly on a pressure plate, or is in direct contact with a drive. In this way, it is possible, for example, for the use of an adapter plate per lower punch to be dispensed with. It is preferred for the pressure plate to be integrated in the punch. To this end, it is possible for example to provide for a punch foot to have a width and a thickness which allow direct connection of a drive. In a further configuration, a connection for the pressure plate is provided at the foot of the punch, preferably a connection which functions via a relative rotation between the pressure plate and punch.

Otherwise, the explanations given above and below apply not only to the lower punch. Rather, it is possible for one or more upper punches to be designed or configured in the same way. According to a further concept of the invention, it is possible in particular for such upper punches, like the proposed lower punches, to be pursued as an independent concept and in combination with the lower punches. The same goes for conical punches with conical structures. In the following text, embodiments, features and further advantages will be explained in more detail by way of an application to lower punches, but without limiting this to lower punches. Rather, corresponding considerations also apply to upper punches and combinations of such upper and lower punches. In the rest of the text, only the term punch will also be used. This is then understood to mean upper punches and lower punches. A superstructure in turn relates to the structural design down to a pressure plate of the associated upper punch. A substructure relates to the structural design down to a pressure plate of the associated lower punch. Corresponding considerations as for the upper and lower punches are also possible for a punch having a conically expanding structure, which will be discussed in more detail in the following text.

In one development, for example, apart from an innermost lower punch, all lower punches have an enlarging region which expands in a conical, in particular cone-shaped or bell-shaped manner.

In a further configuration, a conical extension is located on at least two, preferably all respective lower punches, possibly without the innermost lower punch, arranged as a structure, said conical extension continuing a corresponding conical inner and outer wall of the conical enlargement.

Preferably, the combination of the region with a conical enlargement and a conical extension can be longer than the longitudinal extent. In particular, a substructure is formed in this way. The substructure is in the form of a hollow cone.

Provision can furthermore be made for the cone angles of lower punches that are slidable in one another, or lower punches with extensions, at which the conical enlargement and the conical extension extend away from a press axis, to be at least approximately the same. It is thus preferred for a respective cone angle of the lower punches to remain at least approximately the same from the inside out. However, it is also possible for the cone angles to deviate from one another, wherein the cone angles preferably spread out further from the inside out.

A constant cone angle along the radial extent has the advantage that an effect of bending or a risk of kinking when the pressing forces pass through is very greatly reduced and instead stress distribution becomes very even across the expansion. Preferably, bending stresses in a longitudinal direction can be very greatly reduced by means of the proposed solution.

Furthermore, provision is made for example for the lower punches pushed into one another not to be in contact in the region of their expansion, i.e. with the respective inner wall of the one punch and the opposite outer wall of the opposite punch, preferably not to be in contact at least over most of the expanding extent. A corresponding provision is likewise made for example for an expanding punch having a conically expanding structure and an adjacent punch with an adjacent expanding structure. Provision is made for example for contact between the punches to occur only along a part of a longitudinal extent of the punches, preferably only along an extent of 10 to 30 mm, more preferably only in the region of a die of the powder press. According to one development, provision is made for example for a longitudinal extent of a punch to have what is known as a clearance. A clearance means that the previous dimension of the diameter of the longitudinal extent of a punch is changed to such an extent that no contact with an adjacent punch occurs, but there is otherwise contact in the region of the die. The contacting region in the die serves as a guide, in particular as an upper guide for lower punches and as a lower guide for corresponding upper punches.

In another configuration of the powder press, in a common end position, feet of the respective lower punches end at different heights than one another.

Preferably, compared to one another, the lower punches that slide in one another have approximately the same elasticity in the conically expanding region. For example, compared to one another, the lower punches with a conical structure that slide in one another can have approximately the same elasticity.

It is also possible for feet of the lower punches to end at the same height along a plane in a common end position. In particular, as a result of the proposed solution, an outermost lower punch, or an outermost lower punch with a conically expanding structure, deflects approximately as much as an inner lower punch, or a lower punch with a conically expanding structure. To this end, it is possible for example for the modulus of elasticity and the respective structure to be configured in a corresponding manner in order to set a desired stiffness. Preferably, a stiffness can be increased by design measures. In this way, it is possible to get a grip on the high friction forces that occur for example at the outermost punch and the resulting changes in length on account of a material heating up with an associated change in friction during operation. In particular, structural compensation and, moreover, a convergence of the deflection is created, even in the case of different lengths, as for example in the case of the inner punch, since the great length thereof can result in greater changes in length and greater deflection than in the case of shorter punches. Consideration should also be given here to the fact that, for example, it is possible to combine cone-shaped, long lower punches without structures additionally expanding in a cone-shaped manner and lower punches having structures expanding in a cone-shaped manner. The latter preferably do not exhibit any contact with the adjacent punch in the region of their expansion, but at least do not exhibit any contact with the adjacent punch along most of their extent.

In a further configuration, an outermost lower punch together with a structure deflects at least approximately as much as an inner lower punch with a structure. The advantage of these configurations arises during pressing and in particular when the pressed material is relieved of load, since, as a result, easier load relief across all punches is possible, without the green compact breaking.

According to a further concept, which can be independent of and also dependent on the above text and the following text, a design method for determining a structural solution of the cone-shaped lower punches that are movable in one another, or cone-shaped lower punches with cone-shaped structures, is proposed. In this case, a first evaluation of each lower punch or attached structure is carried out and a check is made as to whether an abort criterion, for example the respective elasticity, has converged with a definable abort criterion, and otherwise at least one parameter is changed until at least this one abort criterion has been met. In this way, depending on specification, the corresponding lower punches that are movable in one another, or lower punches with structure, can be evaluated and designed for example for a converged, in each case uniform elasticity overall.

Preferably, provision is furthermore made for a respective cone angle of the lower punches to increase from the inside out, while the respective longitudinal extent of the lower punches, or the longitudinal extent of the lower punches with the respective structures, decreases from the inside out.

Furthermore, provision is preferably made for a punch holder to directly adjoin the conical enlargement. The conical enlargement of the respective lower punch preferably increases to such an extent that an associated punch holder terminates flush with the lower punch laterally on the outside. In a development, alternatively or in addition, there is flushness on the inside. In this case, provision can be made for the conical enlargement of the lower punch to transition into a cylindrical portion, wherein the cylindrical portion has fastening means for a punch holder, preferably releasable fastening means. Preference is given for example to rotary closures, which make in particular a screw-connection superfluous. It is furthermore preferred for a punch holder to be connected directly to a lower punch by means of a bayonet fastener. This makes it possible, in particular, for a connection between the punch holder and lower punch to take place without a pressure plate and clamping plate.

In the case of a bayonet fastener, it has been found to be advantageous for a fit of the bayonet fastener to have more play radially than axially. The radial play can in this case be greater by a factor of 10 to 50.

In a further configuration, the punches, with or without a structure, adopt such an expanding width that a drive, in particular one or more hydraulic cylinders, can be arranged thereon directly and/or via an adapter plate. Preferably, a foot of the punch or of the structure is so stable that direct contact is also allowed. To this end, it is possible, for example, for that end of the structure or of the punch that is located opposite the longitudinal extent to have a collar.

With regard to the structure of the punch, provision can be made for at least one upper punch and/or one lower punch to be produced in one piece. It is also possible for at least one upper punch and/or one lower punch to be produced in a multipart manner.

Furthermore, provision is made for the punch units that slide in one another to be provided with in each case a different ratio of length of the head piece to length of the enlarging region.

According to a further concept of the invention, which can be pursued independently of and also in dependence on the above concept, a method for operating a powder press is proposed, in which punch units that slide in one another, as described above and/or below, are moved, wherein monitoring in the form of control or regulation is employed, this effecting equalization between different springing behavior of the punch units that slide in one another when the pressure on a pressed workpiece is relieved. Preferably, the equalization is carried out by electronic compensation. In particular, for this purpose, equalization can take place via position control while the lower punches are being moved. Preferably, the method is used in order to create a compact comprising metal powder. Thus, it is possible, for example, to provide here for one punch to spring, while another punch moves, when the pressure on the pressed green compact is relieved. In a further configuration, during setup, equalization on account of different springing behavior of the respective punches or punches with structures does not happen.

Rather, equalization is carried out only by position detection and position control, without prior setting with regard to the elasticity differences.

According to a further concept of the invention, which can be pursued independently of and also in dependence on the above concept, installation of a set of punch units that slide in one another in a powder press is proposed, as described in more detail above and below, wherein these punch units are first of all inserted together and then jointly fastened, i.e. mounted. As a result, individual insertion and individual orientation, as before, is dispensed with. It is also subsequently possible for joint setup to take place. During setup, the filling position, the transfer position, the compression, the relief of pressure and the demolding are preferably checked and finely adjusted with all punch units together. A punch unit otherwise comprises the proposed conical punch and also the conical punch with a conical structure.

An advantage of the proposed powder press is that a compact is able to be produced which has a constant density along a cross section of the compact. It is also possible to fulfill complex shapes, since breakage of the green compact is avoided on account of approximately identical elasticities when the punches are moved away. Preferably, elasticity is designed such that, under operating conditions, respective deflection or rebounding of 5/10 mm or less takes place over all punches.

Furthermore, it is proposed for lower punches that slide in one another of a powder press to be provided, which have at least a plurality of lower punches as described above and below.

According to one configuration, the present invention likewise allows a simplified tool structure while at the same time dispensing with conventional ancillary equipment, in particular pressure plates, with for example the aim of:

- force flow optimization implementable by a geometrically simple, funnel-shaped tool design, particularly in the case of rotationally symmetrical tools;
- reduced effort in construction by dispensing with design optimization;
- dispensing with additive manufacturing methods, since the simple tool elements can generally be produced on standard machine tools by machining methods;
- shortening the inner tool elements, also with acceptance of the lengthening of the outer tool elements;
- dispensing with complete elasticity equalization: equalization is generally still carried out by position control by the machine.

The tool structures can consist, both in one piece and also in a multipart manner by connecting technology, of optionally a head piece, connecting element and foot piece.

Furthermore, in the scope of the disclosure, reference is also made to the applicant's DE 10 2015 201 784.2 and to the applicant's DE 10 2015 201 785.0 with regard to a possible configuration of lower punches that are displaceable in one another. With regard to a possible production method, in the scope of the disclosure, reference is made to the applicant's DE 10 2015 201 775.3.

In particular, as far as uniform pressure application and especially relief of pressure across a width of the compact is concerned, it is advantageous for the lower punches to be constructed in a rotationally symmetrical manner. A further configuration provides punches that are not rotationally symmetrical, in particular asymmetrical, with their punch feet on rotationally symmetrical structures. In this case, the punch feet are preferably likewise rotationally symmetrical. It is also possible for example for asymmetrical foot stiffness to be provided, which serves to provide equalization between a load side and a less loaded side of the asymmetrical punch.

According to a further concept of the invention, which can be pursued independently of and also in dependence on one of the concepts above and/or below, a lower punch and/or upper punch of a powder press, as described above and/or below, is proposed.

According to a further concept of the invention, which can be pursued independently of and also in dependence on one of the concepts above and/or below, a structure for connection to a lower punch and/or upper punch of a powder press, as described above and/or below, is proposed.

According to a further concept of the invention, which can be pursued independently of and also in dependence on one of the concepts above and below, a computer program product with computer program code means which are able to be run on a computer system in order to carry out a method, as described above and/or below, is proposed.

Figure 2:
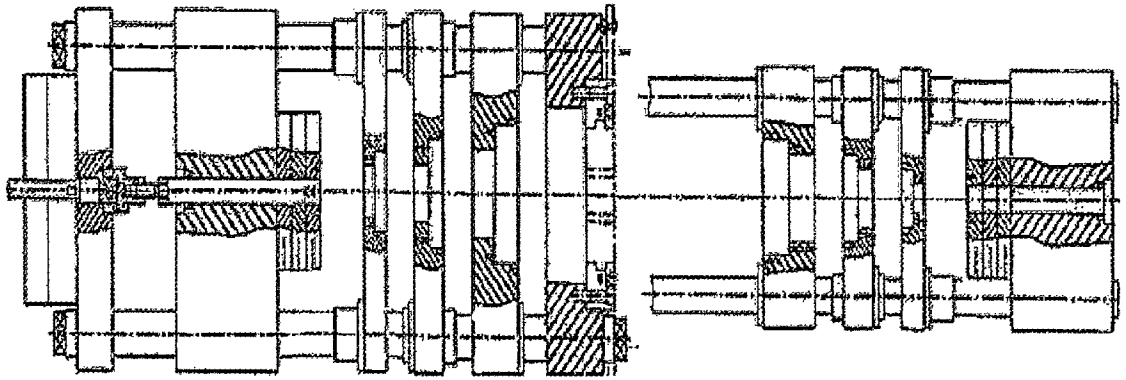
Fig. 2 Prior art
Figure 3:
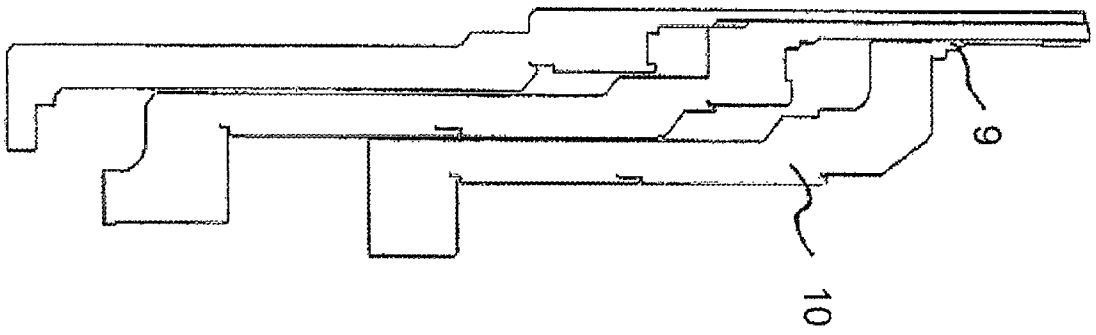
Fig. 3 Prior art
Figure 4:
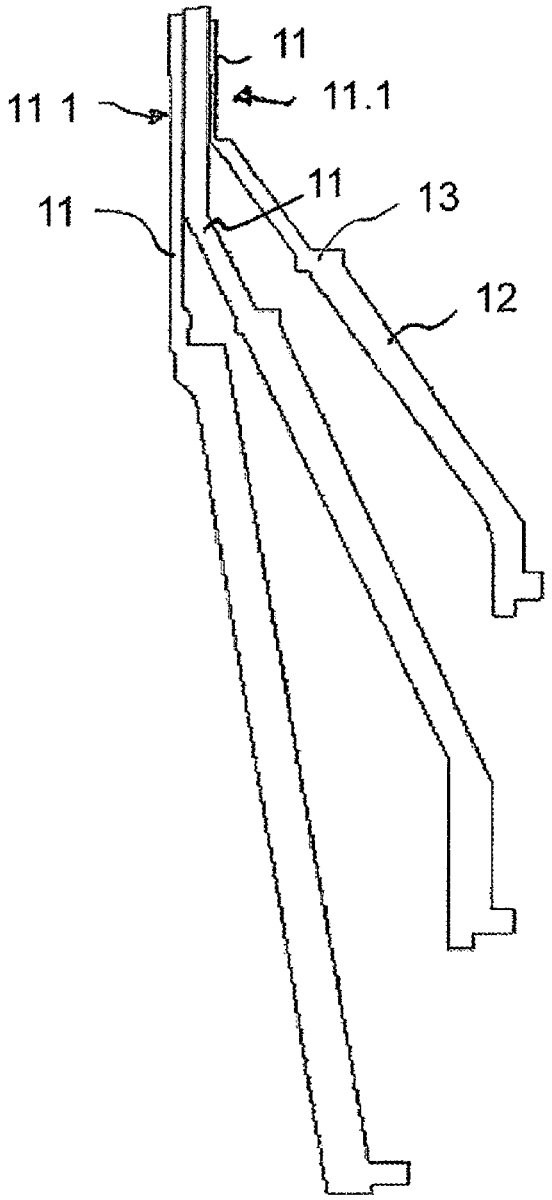
Figure 5:
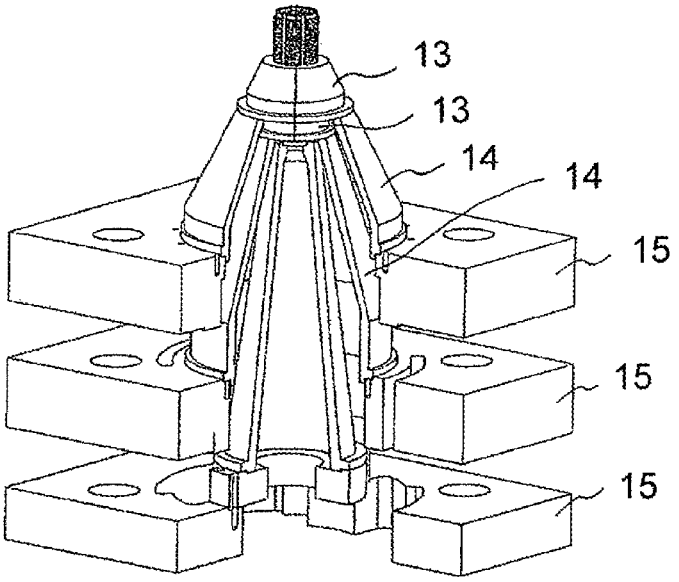
Figure 6:
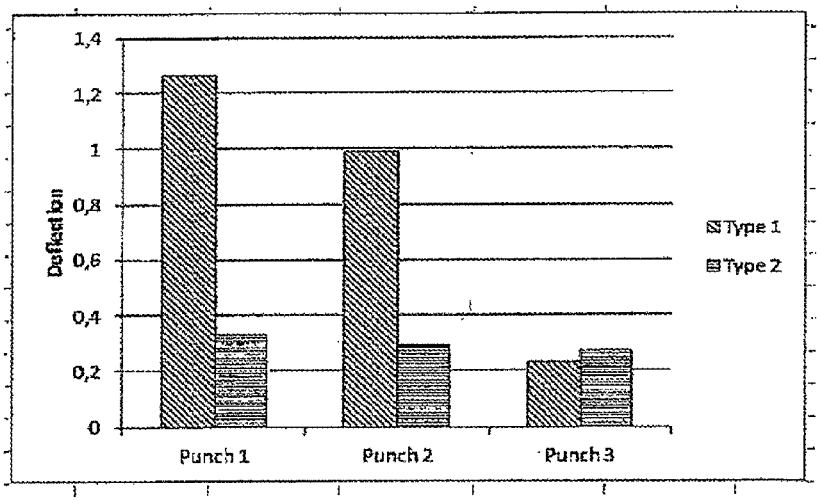
Figure 7:
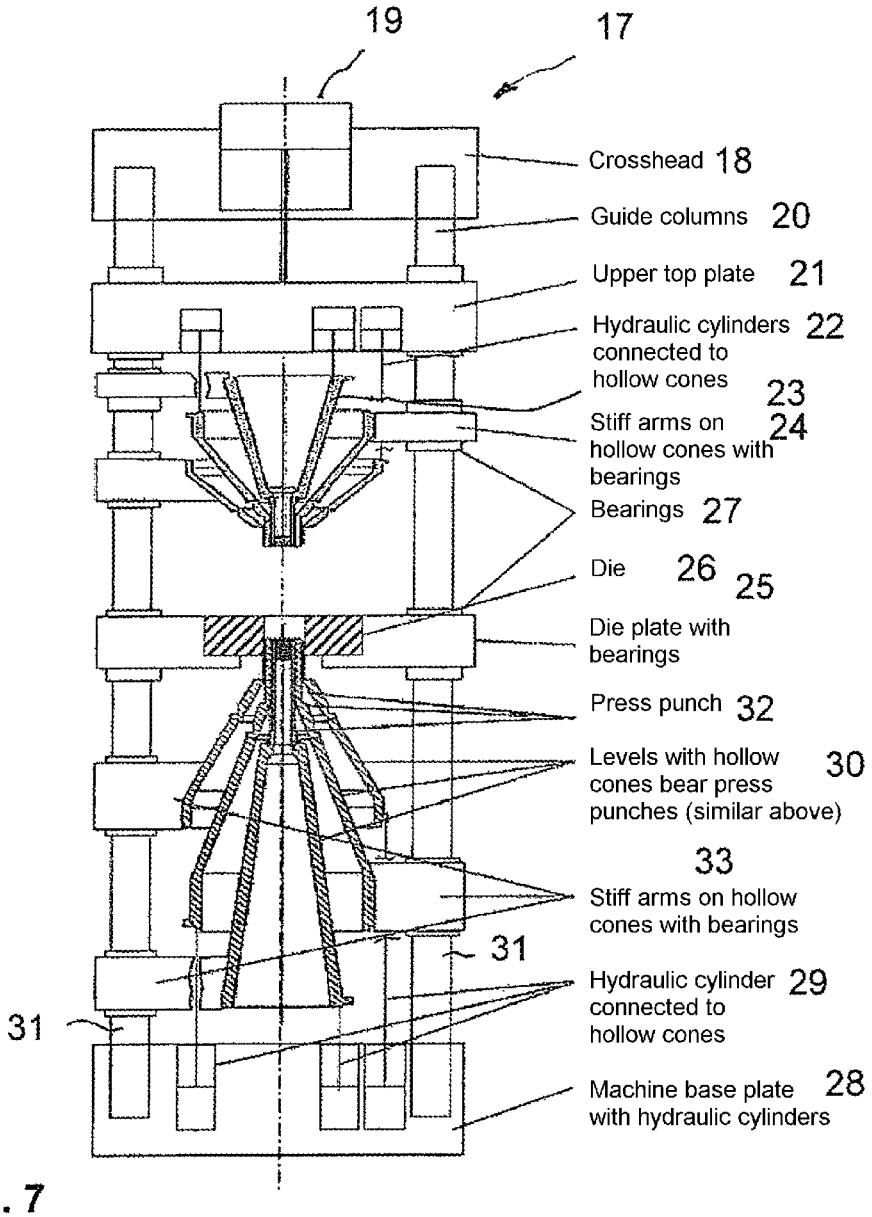

Further advantageous features and configurations can be gathered from the following figures. One or more features from one or more figures and also from the description above and below can, in this case, be combined to form further configurations. In particular, the figures serve to explain the invention and are not intended to limit the latter. Observations and statements which relate to lower punches and lower punches with a conical structure are not limited to lower punches but serve for clarification by way of example. The respective features and configurations are likewise able to be used in proposed upper punches or proposed upper punches with an additional conical structure of a powder press. In the figures:

FIG. 1: shows a detail of a powder press as is known from the prior art,

FIG. 2: shows an exemplary, schematic adapter structure without a tool and substructure but with adapter plates and column structure from the prior art, FIG. 3: shows an exemplary, schematic view of lower punches that are movable in one another, as are known from the prior art, FIG. 4: shows an exemplary, schematic configuration according to the invention of lower punches and attached structures compared to the illustration in FIG. 3, FIG. 5: shows an exemplary schematic design solution with expanding lower punches according to the proposed invention, FIG. 6: shows a comparison of the different springing behavior or elasticity the use of the different systems according to FIG. 3 and according to FIG. 4, and FIG. 7: shows a schematic view of a proposed powder press.

Figure 8:
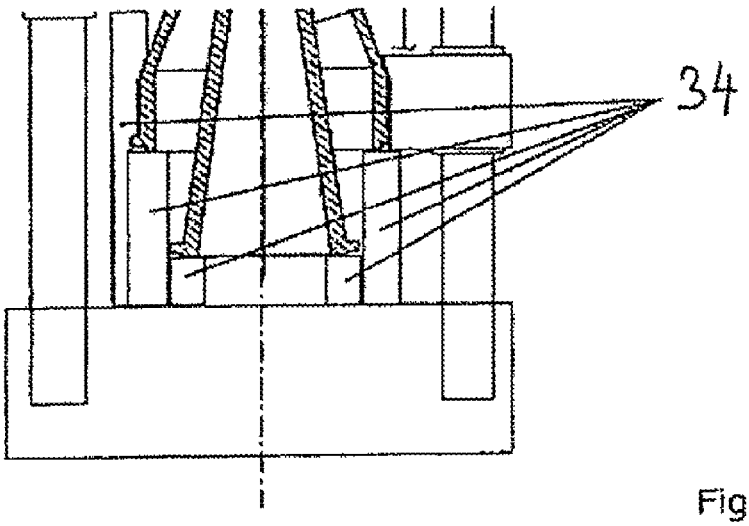

FIG. 8: shows an enlarged view of the powder press from FIG. 7 in order to illustrate stops.

FIG. 1 shows a detail of a powder press 1 as is known from the prior art. This detail shows a part of a tool 2, wherein, however, neither a die nor an upper punch or other components of the powder press 1 are illustrated. What is shown is an adapter plate structure 3 with a lower punch 4. As ancillary equipment, use is made of a screwed-on lock bush 5, a pressure plate 6 and a support ring 7. By means of the lock bush 5, a punch foot 8 is fastened to the pressure plate. The structure of the punches shows, for the one part, the necessary size that has to be provided for such a powder press. For the other part, the setup requires a certain effort, since, for this purpose, the lock bushes or clamping plates and pressure plates also have to be installed, this taking place individually.

FIG. 2 shows an adapter plate structure from the prior art in a simplified, clear illustration. For the upper and also the lower punches, which are not shown in more detail here, an adapter plate has to be installed in each case per punch. Little by little, one adapter plate after another can be attached upwardly and also downwardly, for which purpose the respective structure has to be moved in the press. This operation is very time-consuming and requires a large number of individual parts.

FIG. 3 likewise shows a simplified sectional view, for better understanding, of a structure, known from the prior art, with a lower punch 9 and attached structures 10. These extend, as already illustrated in FIG. 1, substantially along a movement axis of the press. In particular, the respective inner and adjacent outer wall of adjacent punches slide on one another, since, in such a structure, the punches are guided thereby.

FIG. 4 shows a structure according to the invention with lower punches 11 which have a conical expansion, to which respective cone-shaped structures 12 are attached, to which a punch holder for example is then directly attachable. The structures 12 are connected here to the lower punches 11 by feet 13 that are illustrated only schematically. It is preferred, as illustrated, for an angle of the conical expansion of the respective lower punch 11 to be adopted and continued by the cone-shaped structure 12. An exemplary configuration is a substantially conical-rectilinear embodiment of the expansion. A bell-like design of the expansion is likewise possible. As illustrated, contact occurs only in the region of the lower punches, and in that case only in the region of the longitudinal extent 11.1 thereof. Otherwise, the walls are spaced apart from one another.

FIG. 5 shows an exemplary, schematic design solution, in which the illustrated lower punches 13 move in one another and a conical expansion results overall. Attached to the punch feet are conical structures 14, the conical profile of which continues as far as the illustrated adapter plates 15.

FIG. 6 shows a comparison of the respective elasticity firstly with the type 1 system from FIG. 3 and secondly with the type 2 system from FIG. 4. As illustrated, it is possible to bring the corresponding properties of the respective lower punches or lower punches with a structure very close to one another, as proposed. This can result, in particular, for example, in the press control not needing any elasticity equalization between the punches during movement, in particular during relief of pressure.

FIG. 7 shows a schematic, simplified view of a powder press 17 according to the invention. For better understanding, the individual components of the powder press 17 are provided with reference signs in the figure and explained in the following text. The illustrated section is not planar, but partially rotated for the sake of clarity. As a result, those components are also visible which, arranged around a periphery of the powder press 17, would not otherwise be visible. A crosshead 18 of the powder press 17 is connected to a hydraulic main cylinder 19 for a pressing force. However, it is also possible for some other drive to be provided, for example a worm drive. Furthermore, the crosshead 18 is firmly connected to two illustrated guide columns 20. An upper top plate 21 is movable, wherein, for example, at least two diagonally opposite hydraulic cylinders 22 per level are used. Each level preferably has hollow cones 23 as a conical expansion of a structure or of a punch with in each case at least two stiff arms 24 with guide bearings 27, each with respect to two diagonally opposite columns. A die plate 25 with the die 26 is held in a movable manner. As a result, a take-off method can be implemented. A drive for this purpose can also be provided in a base plate. The machine base plate 28 of the powder press 17, also known as foundation plate, has at least two diagonally opposite cylinders, preferably hydraulic cylinders 29, per level, which are connected to a hollow cone 30, specifically one each per tool-punch level. The machine base plate 28 bears the hydraulic cylinders 29 and is firmly connected to the columns 31. The hydraulic cylinders 29 can be replaced for example completely or in part by some other drive, for example by a respective electric spindle drive. Also illustrated are the lower punches 32 with attached structures in the form of the hollow cones 30. In the region of the substructure, too, the lower punches or the hollow cones 30 are supported via stiff arms 33. Otherwise, it should be noted that, for the sake of clarity, only the sections through the shaping tools and the conical structure parts are illustrated in a hatched manner.

According to a further concept, which can be independent of or dependent on the above and the following, a guide of the punch units is proposed, which has a first contacting region in the die as guide, in particular as an upper guide for lower punches and as a lower guide for corresponding upper punches. A second guide takes place as an external guide of the hollow cones, as explained and illustrated above. In this way, defined movability along a powder press axis can be created.

FIG. 8 shows a detail of the illustration in FIG. 7. However, for better clarity, the hydraulic cylinders have been omitted and various stops 34 illustrated instead. Said stops can be used according to one configuration. A stop can be arranged in a stationary and also in an adjustable manner.

The invention claimed is:

1. A powder press comprising a tool structure with punches nested in one another, wherein each punch has a longitudinal extent having a head piece which is guided in a die and at least two of the punches further each have a respective conical enlargement which is adjoined to the respective longitudinal extent, wherein the conical enlargements are able to be guided one in another, wherein the conical enlargement has a conically expanding inner and outer wall, and each respective conical enlargement is longer than the respective longitudinal extent.

2. The powder press as claimed in claim 1, wherein a conical extension is located on at least two respective punches, said conical extension continuing a corresponding conical inner and outer wall of the conical enlargement.

3. The powder press as claimed in claim 2, wherein a cone angle at which the conical enlargement and the conical extension extend away from a press axis is at least approximately the same.

4. The powder press as claimed in claim 1, wherein, in a common end position, feet of the respective punches end at different heights than one another.

5. The powder press as claimed in claim 1, wherein the punches that slide in one another have approximately the same elasticity in the conical enlargement.

6. The powder press as claimed in claim 1, wherein the punches, each with a conical structure that slide in one another, have approximately the same elasticity.

7. The powder press as claimed in claim 1, wherein feet of the punches end at the same height along a plane in a common end position.

8. The powder press as claimed in claim 1, wherein an outermost punch deflects approximately as much as an associated inner punch.

9. The powder press as claimed in claim 1, wherein an outermost punch deflects approximately as much as an associated inner punch wherein the outermost punch and the associated inner punch each have a respective conical structure that slide into one another.

10. The powder press as claimed in claim 1, wherein a punch holder directly adjoins the conical enlargement at an end opposite to the longitudinal extent.

11. The powder press as claimed in claim 1, wherein the conical enlargement of the respective punch increases to such an extent that an associated punch holder terminates flush with the punch laterally on an outside.

12. The powder press as claimed in claim 1, wherein the conical enlargement of the respective punch transitions into a cylindrical portion, wherein the cylindrical portion has a fastening structure for a punch holder.

13. The powder press as claimed in claim 12, wherein a punch holder is connected directly to the respective punch by a bayonet fastener.

14. The powder press as claimed in claim 1, wherein a connection between a punch holder and punch takes place without a pressure plate and clamping plate.

15. The powder press as claimed in claim 1, wherein at least one of the punches are produced in one piece.

16. The powder press as claimed in claim 1, wherein at least one of the punches are produced in a multipart manner.

17. The powder press as claimed in claim 1, wherein the punches that slide in one another are provided with in each case a different ratio of length of the head piece to length of the conical enlargement.

18. A method for operating a powder press according to claim 1, the method comprising:

moving the punches that are nested in one another, and employing monitoring in the form of control or regulation, this effecting equalization between different elasticities of the punches that slide in one another when the pressure on a pressed workpiece is relieved.

19. The method as claimed in claim 18, further comprising electronically compensating for a difference in elastic deflection.

20. The method as claimed in claim 18, further comprising equalizing via position control while the punches are being moved.

21. The method as claimed in claim 18, further comprising creating a compact from powder metal using the powder press.

22. A method of setting up of the powder press according to claim 1, wherein said punches are first of all installed together and are then jointly set up.

23. The powder press as claimed in claim 1, wherein the punches that have conical enlargements are lower punches.

* * * * *